US011471353B2

(12) United States Patent
McClain et al.

(10) Patent No.: US 11,471,353 B2
(45) Date of Patent: Oct. 18, 2022

(54) ROTATING AUTOPSY TABLE

(71) Applicant: MP ACQUISITION, LLC, Oak Park, MI (US)

(72) Inventors: Michael Scott McClain, Waterford, MI (US); Stephen Roy Jamison, Grove City, PA (US); Jeffery Neil Nutting, Chesterfield, MI (US)

(73) Assignee: MP Acquisition, LLC, Madison Hts., MI (US)

( * ) Notice: Subject to any disclaimer, the term of this patent is extended or adjusted under 35 U.S.C. 154(b) by 216 days.

(21) Appl. No.: 16/601,731

(22) Filed: Oct. 15, 2019

(65) Prior Publication Data

US 2020/0121534 A1 Apr. 23, 2020

Related U.S. Application Data

(60) Provisional application No. 62/746,792, filed on Oct. 17, 2018.

(51) Int. Cl.
*A61G 13/00* (2006.01)
*A61G 13/04* (2006.01)

(52) U.S. Cl.
CPC ..... *A61G 13/0027* (2013.01); *A61G 13/04* (2013.01)

(58) Field of Classification Search
CPC .. A61G 13/0027; A61G 13/00; A61G 13/102; A61G 13/04; A61G 7/001; A47B 19/06; A47B 27/02; A47B 2200/0043; A47B 2200/0046; A47B 11/00; A47B 2023/047; A47B 2023/48;

(Continued)

(56) References Cited

U.S. PATENT DOCUMENTS 2,512,747 A 6/1950 Lewis
2,702,505 A 2/1955 Nelson
(Continued)

FOREIGN PATENT DOCUMENTS

GB 2540996 * 8/2015 ..... A61G 13/02
JP 2003319943 11/2003
WO WO 9305745 A1 4/1993

OTHER PUBLICATIONS

"What Is an Autopsy?" Pathology, https://medicine.yale.edu/pathology/clinical/autopsy/whatisautopsy/.*

(Continued)

*Primary Examiner* — David R Hare
*Assistant Examiner* — Madison Emanski
(74) *Attorney, Agent, or Firm* — Raggio & Dinnin, P.C.

(57) ABSTRACT

A table for use in an autopsy, necropsy, pathology or dissection procedure, wherein the table comprises a base and a carrier rotatably connected to the base. The table also comprises a first tray arranged within the carrier and a second tray arranged within the carrier. The second tray is parallel to the first tray when in a first position and the second tray and the first tray having a predetermined sized gap arranged therebetween when the carrier is in a first position. The rotating autopsy table may allow for a single user of the table to perform an autopsy procedure on the front of a cadaver or body and then rotate the table on their own, such that the autopsy procedure may be continued on the back of the body without help from other equipment or other people to flip or turn the body over.

18 Claims, 7 Drawing Sheets

(58) Field of Classification Search
CPC ..... A47B 2037/005; A47B 21/02; A47B 2021/0342; A47B 2021/035; A61B 16/00; A61M 1/00; A01N 1/00; A01N 1/02; A01N 1/0236; A01N 1/0273
See application file for complete search history.

(56) References Cited

U.S. PATENT DOCUMENTS

| | | | | |
|---|---|---|---|---|
| 3,799,534 | A | 3/1974 | Coles | |
| 3,874,754 | A | 4/1975 | Saunders et al. | |
| 4,038,974 | A | 8/1977 | Pielkenrood | |
| 4,140,105 | A | 2/1979 | Duvlis | |
| 4,402,144 | A | 9/1983 | Dumke | |
| 4,422,369 | A | 12/1983 | Smets | |
| 4,650,171 | A | 3/1987 | Howorth | |
| 4,876,773 | A | 10/1989 | Wade | |
| 4,898,089 | A | 2/1990 | Roos | |
| 4,901,410 | A | 2/1990 | Fischer et al. | |
| 4,980,956 | A | 1/1991 | Fischer et al. | |
| 5,042,456 | A | 8/1991 | Cote | |
| 5,093,969 | A | 3/1992 | McGuire | |
| 5,181,883 | A | 1/1993 | Hofstra et al. | |
| 5,244,433 | A | 9/1993 | Utterback | |
| 5,303,659 | A | 4/1994 | Berlin et al. | |
| 5,620,407 | A | 4/1997 | Change | |
| 5,621,929 | A | 4/1997 | Smith | |
| 5,904,162 | A | 5/1999 | Ferguson et al. | |
| 6,050,660 | A | 4/2000 | Gurley | |
| 6,279,510 | B1 | 8/2001 | Batterton | |
| 6,282,736 | B1 * | 9/2001 | Hand | A61B 6/0428 5/608 |
| 6,694,892 | B2 | 2/2004 | Lin et al. | |
| 7,428,882 | B2 | 9/2008 | Keil | |
| 7,468,161 | B2 | 12/2008 | Reinhardt et al. | |
| 9,295,433 | B2 * | 3/2016 | Jackson | A61B 6/0407 |
| 9,463,129 | B2 | 10/2016 | Hallman | |
| 9,597,043 | B1 * | 3/2017 | Mirza | A61B 6/0421 |
| 2003/0033790 | A1 | 2/2003 | Hague | |
| 2005/0160948 | A1 | 7/2005 | Irwin | |
| 2006/0154590 | A1 | 7/2006 | Kanaya | |
| 2006/0180057 | A1 | 8/2006 | Hallman | |
| 2008/0202491 | A1 | 8/2008 | Eberhand | |
| 2012/0037049 | A1 | 2/2012 | Martin et al. | |
| 2012/0260418 | A1 | 10/2012 | Rundberg et al. | |
| 2015/0052975 | A1 | 2/2015 | Martin | |
| 2015/0079894 | A1 | 3/2015 | Zimmerman | |
| 2017/0087040 | A1 | 3/2017 | Hallman | |
| 2017/0112698 | A1 * | 4/2017 | Hight | A61G 13/104 |
| 2017/0360639 | A1 | 12/2017 | Corona et al. | |

OTHER PUBLICATIONS

"Flange." Merriam-Webster, Merriam-Webster, www.merriam-webster.com/dictionary/flange.*

Apzem—Grossing Workstation, Jun. 20, 2016 (dating is based on Google Search); Table Top Grossing Station (AT Series) Retrieved from the Internet. URL: http://www.grossingstation.com/table-top-grossing-station-2/; Formaldehyde Monitor in Grossing Workstation—Retrieved from the Internet. URL: http://www.grossingstation.com/formaldehyde-monitor/.

* cited by examiner

ROTATING AUTOPSY TABLE

This application claims the benefit of U.S. Provisional Patent Application 62/746,792—Filed: Oct. 17, 2018

BACKGROUND OF THE INVENTION

1. Field of the Invention

The present invention generally relates to an autopsy or dissection table and more particularly relates to a rotating autopsy or dissection table for use in performing autopsies on both sides of a cadaver.

2. Description of Related Art

Autopsy tables, grossing tables, necropsy tables and dissection tables are all well known in the art. These tables are designed to accommodate a body or a part of a body while a post mortem examination is carried out or pathology is conducted on an organ or other body part. Many prior art autopsy tables are generally made of a stainless steel material and may include perforated surfaces, etc. While performing autopsies or anatomical dissections, the cadaver often must be accessed from different perspectives including from either the front, back or side. In the prior art, the turning of the body completely over from the front to back may be very difficult, especially if the body is large and the person performing the autopsy or dissection is small. Furthermore, if the body or cadaver has already been partially opened it also makes it very difficult to turn the body over from a top side to a back side of the cadaver being autopsied. With the general population is trending towards larger or bariatric people, multiple people may be needed to flip over a cadaver of a person or animal. Furthermore, sometimes special lifting equipment may be required at great expense to perform such flipping maneuvers, wherein this equipment also consumes valuable space in the laboratory in which the post-mortem examination is taking place.

Therefore, there is a need in the art for an improved autopsy table that rotates. There also is a need in the art for an improved autopsy table that is capable of flipping the cadaver or body from a front to a back position for the person performing the autopsy using standard body trays and no additional lifting mechanisms required for the flipping motion. There also is a need in the art for a rotating autopsy table that may rotate the cadaver between the front side of the cadaver and the back side of the cadaver by one person, while holding the cadaver firmly in place within the rotating autopsy table during such rotating procedure. There is also a need in the art for a rotating autopsy table that is low in cost while also being easy to install in the laboratory in which the autopsies may be performed. There is also a need in the art for a rotating autopsy table that is capable of using a first and second carrier, wherein one of the carriers may rotate into a stored position for an autopsy procedure to be performed on either the front or back of the cadaver arranged thereon.

SUMMARY OF THE INVENTION

One object of the present invention may be to provide a novel and unique autopsy table.

Another object of the present invention may be to provide a rotating autopsy table that is capable of flipping a cadaver from a front or face up position to its back or face down position.

Still another object of the present invention may be to provide a rotating autopsy table that uses two standard cadaver trays in order to flip a cadaver over.

Still another object of the present invention may be to provide a rotating autopsy table that uses two carriers that are connected at a pivot point and rotate about one another in order to secure a cadaver therein during a flipping operation and is capable of being stored in a position underneath the rotating autopsy table in order to allow for the autopsy procedure to be performed thereon.

Still another object of the present invention may be to provide a rotating autopsy table that includes a central pivot point that allows for a single individual to rotate and flip over a cadaver from a face side up to a face side down.

Still another object of the present invention may be to provide a rotating autopsy table having a lock pin arrangement that allows for the cadaver to be secured within a first and second carrier during the flipping operation being performed thereon.

Yet another object of the present invention may be to provide a rotating autopsy table that is low in cost, easy to manufacture and provides an ease of use for one person to flip any size cadaver from a face up position to a face down position or vice versa.

According to the present invention, the foregoing and other objects and advantages are obtained by a novel design for a rotating autopsy table for use in autopsy, necropsy, pathology or dissection procedures. The rotating autopsy table comprises a base or frame. The rotating autopsy table also comprises a first and second carrier. The first and second carrier are arranged parallel to one another with a predetermined sized gap arranged therebetween. Each of the carriers includes a pocket which may hold and secure a cadaver tray therein. The first and second carrier are generally secured via a pivot point at one end thereof. When the first and second carrier are secured to one another and form an overall carrier unit, it generally forms a U-shape when viewed from the side. The rotating autopsy table may allow one person to take a body that is laying on its back during the initial autopsy procedure and rotate that person onto their stomach so that an autopsy may be performed through the back of the cadaver being examined. The rotating autopsy table may allow for the carrier to be locked in position with respect to the base or frame when the autopsy procedure is being performed thereon. During rotation, a locking pin may be removed which may allow for the central pivot to rotate the body between a face up and face down position during the autopsy procedure. After the body is secured in the proper position for the autopsy procedure being conducted thereon, either the first or second carrier may be rotated via a rotating connection therebetween into a storage position underneath the cadaver tray in use. It should further be noted that it is contemplated to use a plurality of posts, pegs or straps to secure the cadaver in a predetermined position during the flipping or rotating procedure of the cadaver from the face up to the face down position or vise versa.

One advantage of the present invention may be that it provides a novel and unique autopsy table.

Another advantage of the present invention may be that it provides for a rotating autopsy table.

Still another advantage of the present invention may be that it provides a rotating autopsy table that includes a first and second carrier that are pivotally connected to one another on an end thereof.

Still another advantage of the present invention may be to provide a rotating autopsy table that includes a first and second cadaver tray arranged within a first and second carrier respectively for supporting the cadaver body in either a face up position or a face down position.

Still another advantage of the present invention may be to provide a rotating autopsy table having a central pivot point that allows for one person to rotate a cadaver between a face up and face down position.

Still another advantage of the present invention may be to provide a rotating autopsy table that includes a locking pin that allows for the carrier to be locked to the base or frame so the proper autopsy procedure may be conducted thereon.

Still another advantage of the present invention may be to provide a rotating autopsy table that is low in cost, easy to use, easy to manufacture and easy to install within the laboratory in which it is being used.

Other objects, features and advantages of the present invention will become apparent from the subsequent description, and appended claims taken in conjunction with the accompanying drawings.

DESCRIPTION OF THE EMBODIMENT(S)

Figure 1:
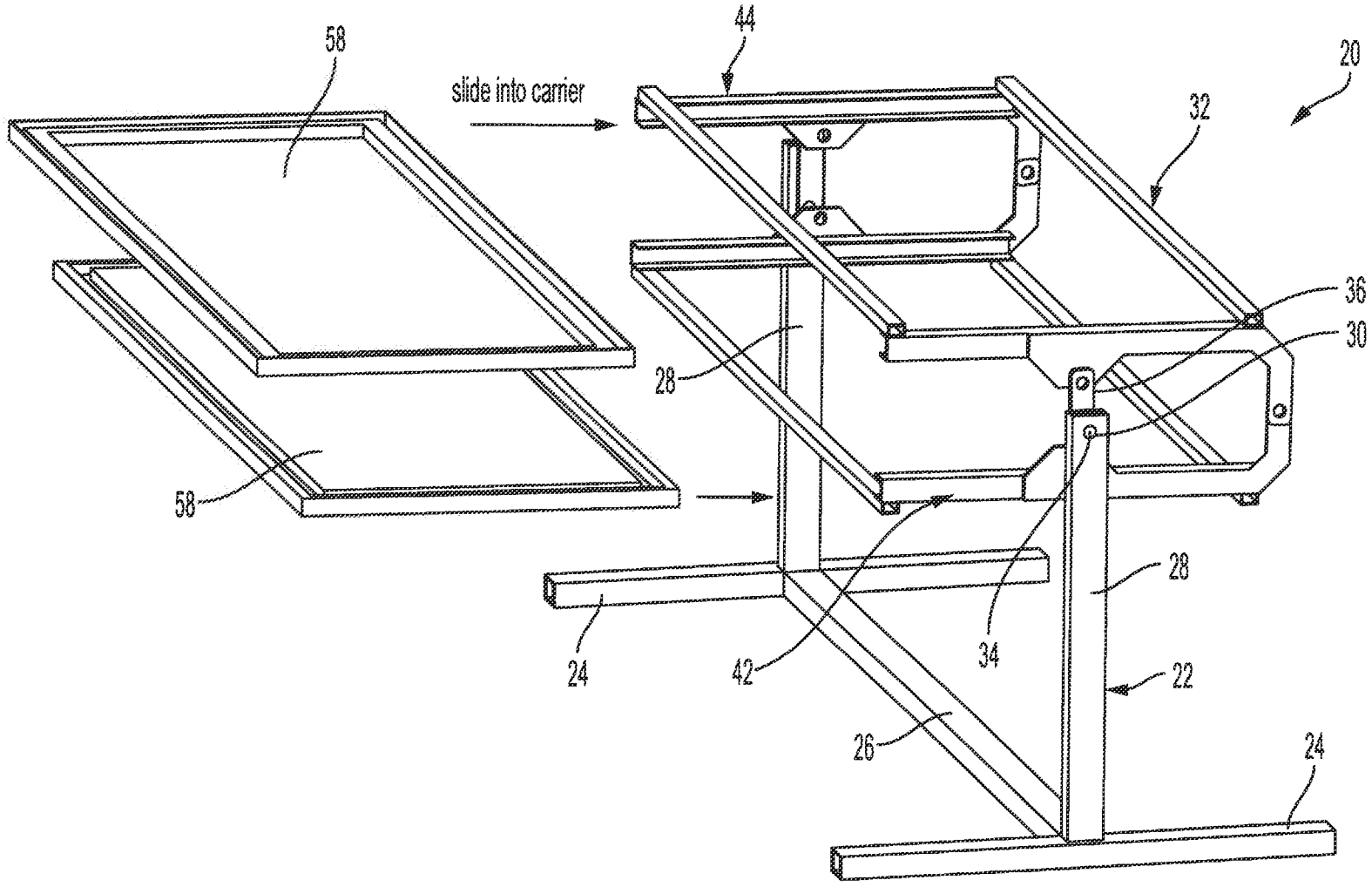
FIG. 1 shows a perspective view of a rotating autopsy table according to the present invention.
Figure 2:
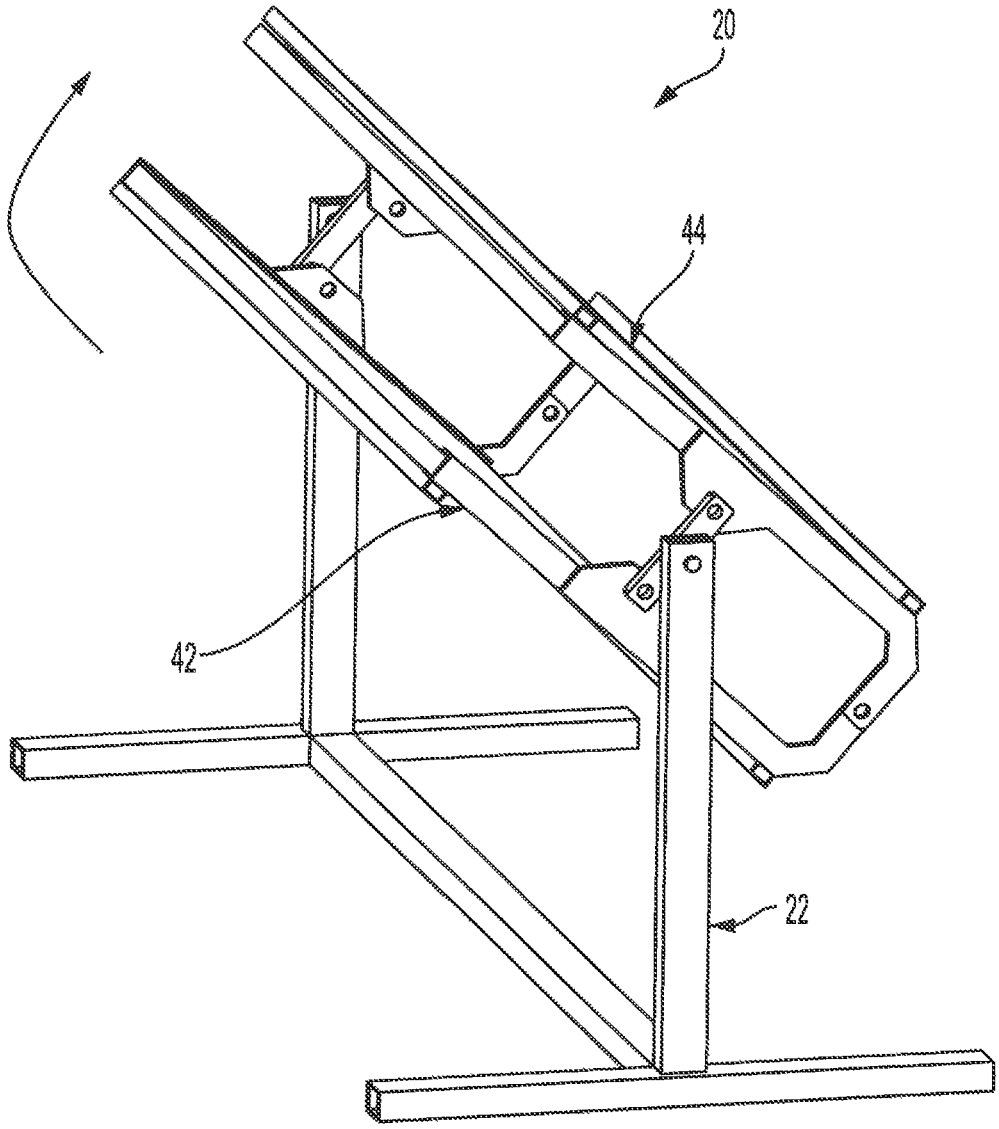
FIG. 2 shows a perspective view of the rotating autopsy table being rotated according to the present invention.
Figure 3:
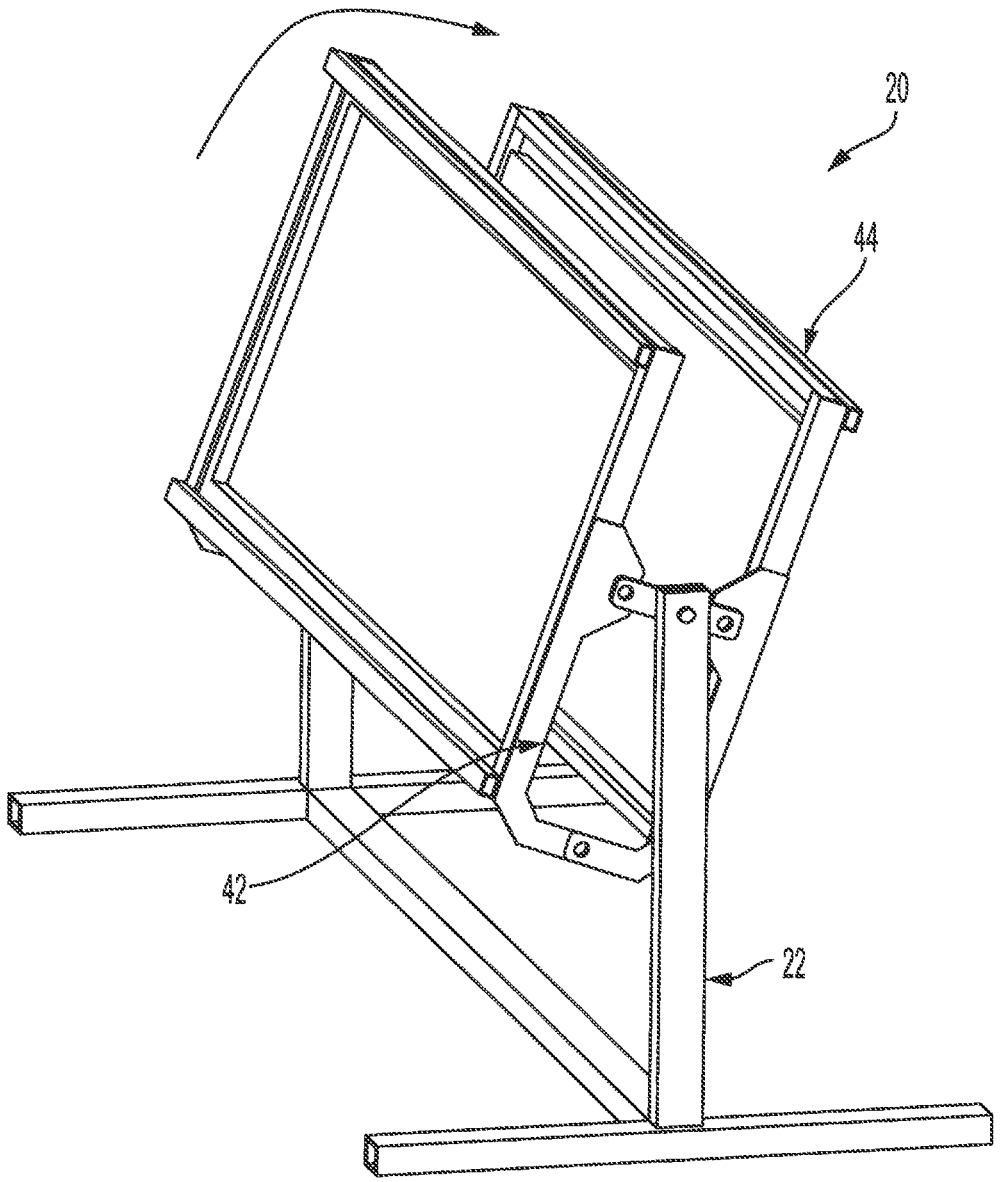
FIG. 3 shows a perspective view of the rotating autopsy table being rotated according to the present invention.
Figure 4:
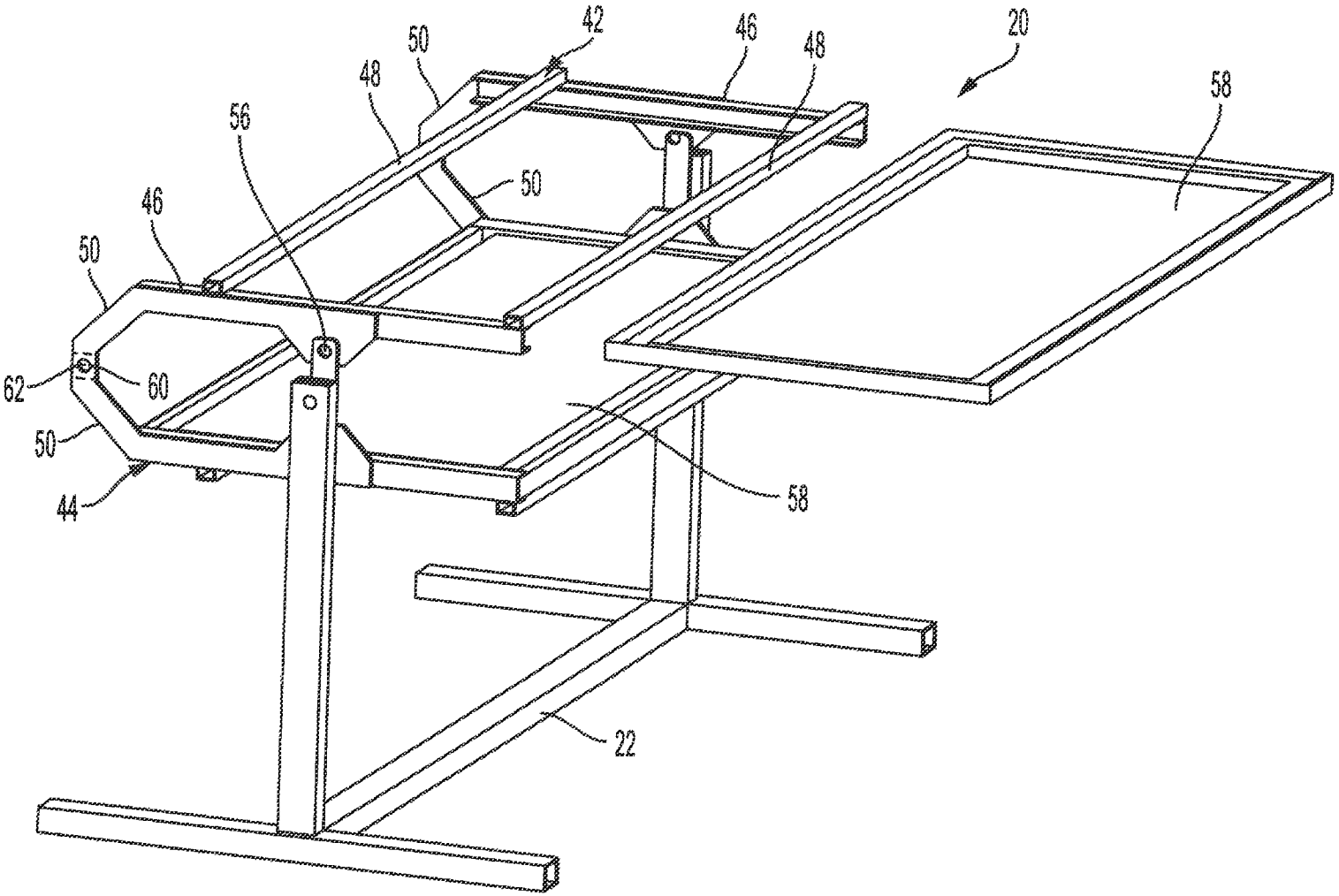
FIG. 4 shows a perspective view of the rotating autopsy table according to the present invention.
Figure 5:
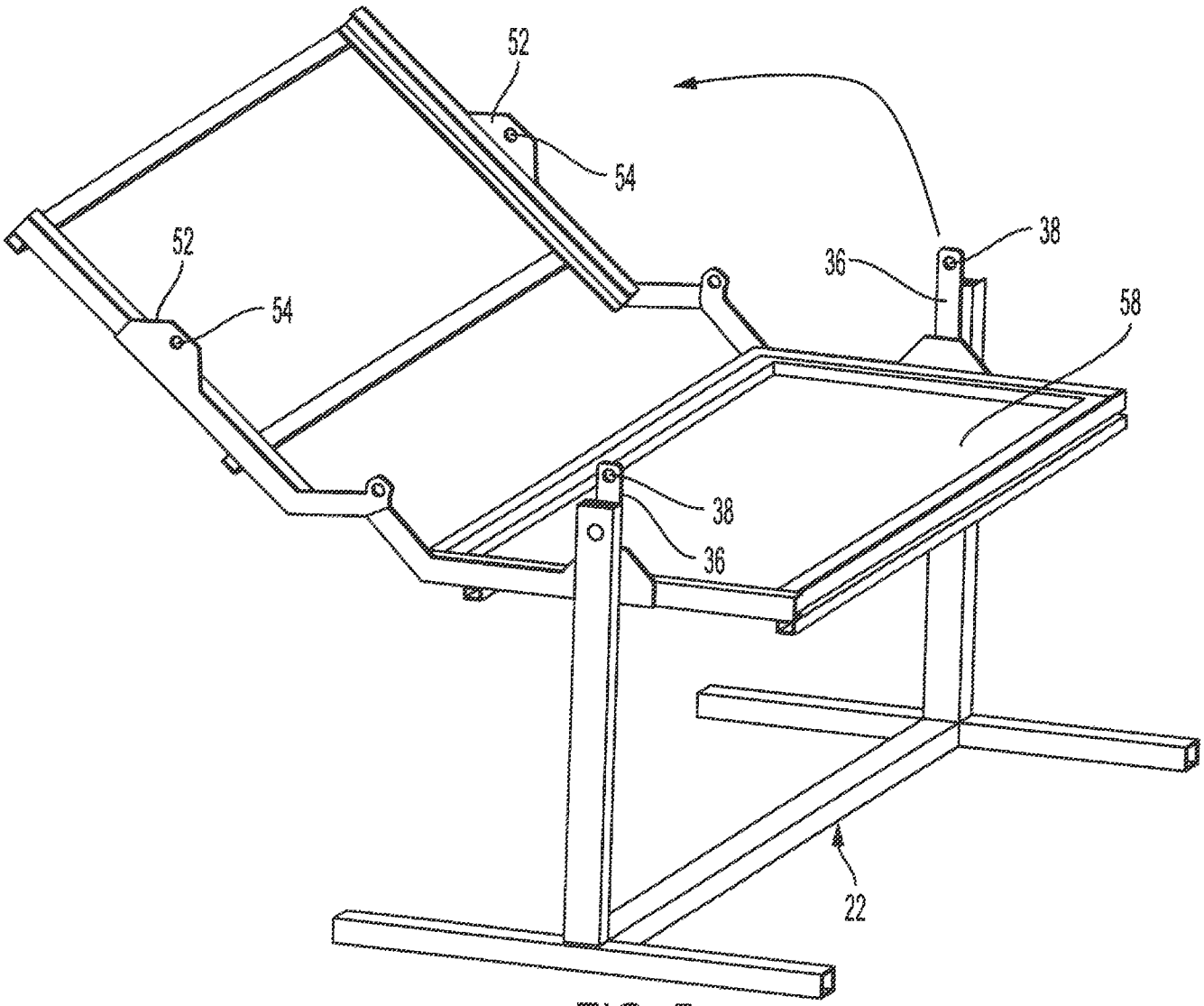
FIG. 5 shows a perspective view of the rotating autopsy table having a carrier rotated into a stored position.
Figure 6:
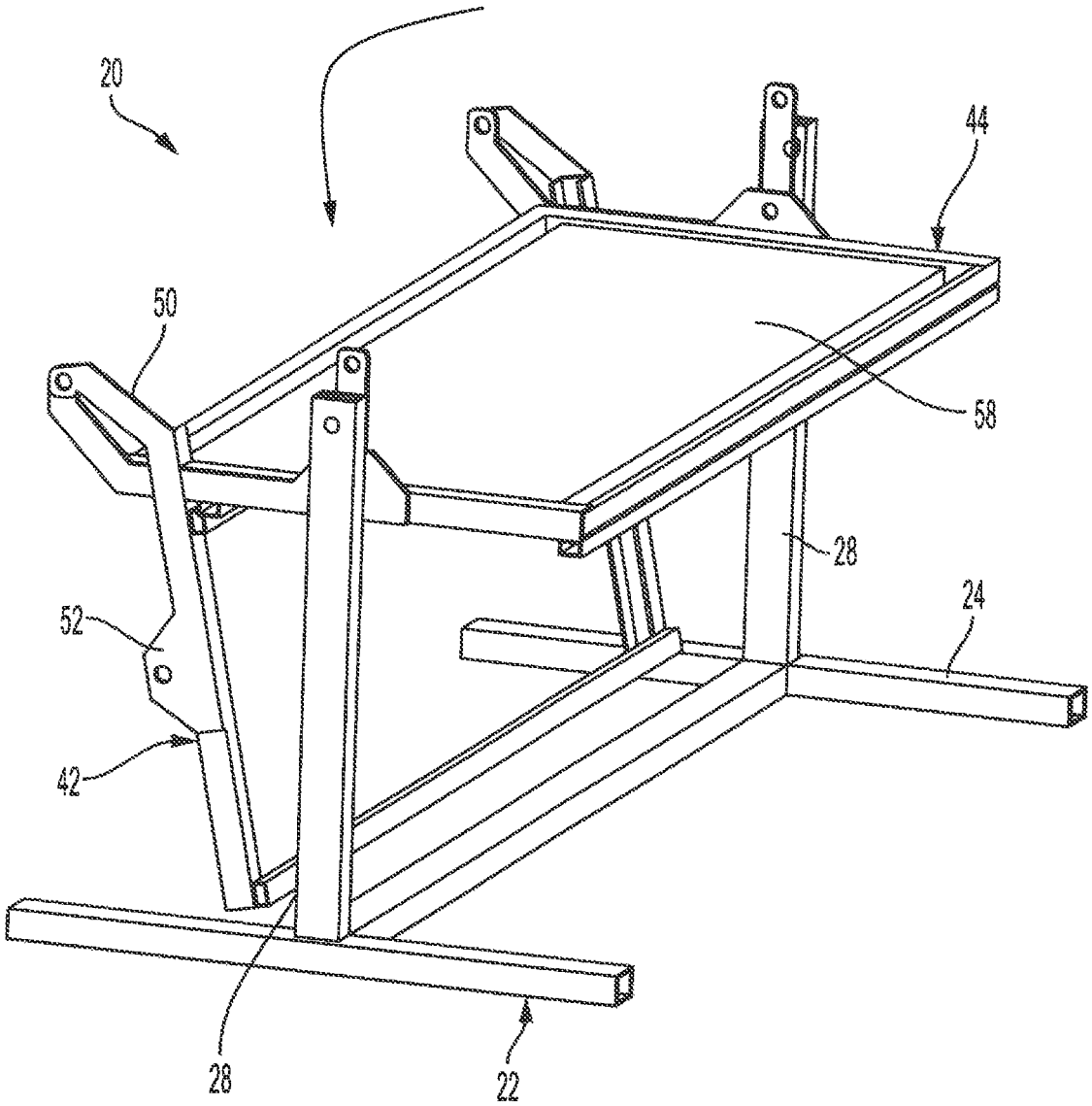
FIG. 6 shows a perspective view of the rotating autopsy table with a carrier in the stored position.
Figure 7:
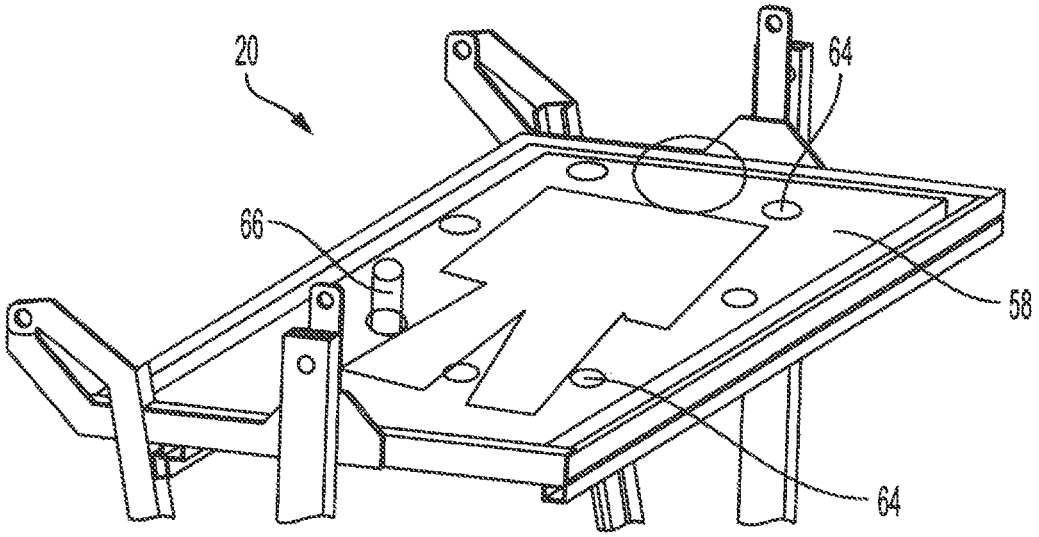
FIG. 7 shows a perspective view of a cadaver arranged on a cadaver tray of the rotating autopsy table according to the present invention.
Figure 8:
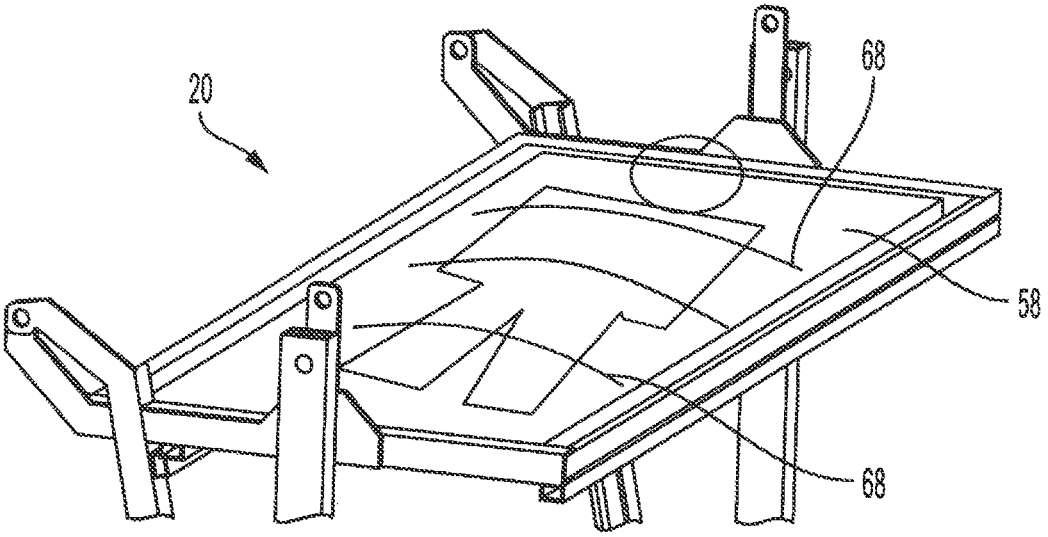
FIG. 8 shows an alternate embodiment of a cadaver arranged and held on a cadaver tray of the rotating autopsy table according to the present invention.

Referring to the drawings, a rotating autopsy or dissection table 20 that is capable of rotating or flipping a cadaver from a face up to a face down position is shown according to the present invention. It should be noted that the rotating autopsy table 20 may be used in any known autopsy, necropsy, trimming, pathology, dissection, or any other procedure performed on tissues or bodies all of which are for use in hospitals, morgues, funeral homes, university laboratories, other laboratories, or any other structures that may be used for examining human or animal bodies or human or animal body parts in a post mortem examination. It is known in the prior art that it has been increasingly difficult and more of a challenge in anatomy and necropsy laboratories and medical examination offices to flip or turn over a cadaver or animal from a face up position to a face down position in order to examine the front and back of the person or animal being autopsied. Generally, as the population in the world tends towards being heavier or bariatric, this often requires multiple people to flip or turn over a cadaver in order to examine the cadaver's backside. It is even known in the art that sometimes special lifting equipment is required at great expense to the operator of the laboratory to flip the cadaver from a face up to a face down position. This equipment also consumes valuable space in the laboratory. Therefore, the rotating autopsy table 20 of the present invention may be able to combine the flip operation into one rotating autopsy table 20 which may allow for a single person using standard body trays and no additional lifting mechanisms to rotate a cadaver from a face up to a face down position in order to perform an autopsy on the front side and the back side of the specimen.

The rotating autopsy table 20 of the present invention generally may include a base or frame 22. Generally, the base or frame 22 may include a first and second leg 24 with a cross member 26 arranged therebetween secured to the first and second leg 24 at generally a mid point thereof. The frame 20 generally may also include a first and second arm 28, one each extending respectively from the first and second leg 24 in a perpendicular direction from the leg 24 of the base 20. Generally, the first and second arm 28 may be arranged at or near the cross member 26 of the base 22 and may form a right angle or be perpendicular with respect to the leg 24 and cross member 26. It should be noted that generally the members of the base 22 may be made of a stainless steel material, however any other known metal, ceramic, composite, plastic, natural material or non-natural material may be used to form the components of the base 22. It should be noted that the legs 24, arms 28 and cross member 26 of the base 22 may be rectangular in shape and may have a hollow bore arranged therethrough. The cross section of the base components may either be square, rectangular, or any other known shape. It is also contemplated that the legs 24 of the base 22 may also include adjustable pads or feet arranged on the bottom thereof in order to allow for the rotating autopsy table 20 to be set and balanced in a proper manner with respect to the floor on which the rotating autopsy table 20 may be arranged. Arranged near the top end of both the first and second arm 28 of the rotating autopsy table 20 may be at least one central pivot orifice 30 therethrough. The orifice 30 generally may have a circular shape and may allow for a carrier 32 to be rotatingly secured to the base 22 of the rotating autopsy table 20. It should be further noted that other orifices may also be arranged through the first and second arm 28 at a plurality of various positions including another arranged near the central pivot orifice 30 in order to lock the carrier 32 in position with respect to the base 22 so that an autopsy procedure may be performed on a cadaver arranged thereon. It should be noted that any orifice arranged through the arms 28 of the base 22 generally are circular, however any other shaped orifice including but not limited to square, oval, triangular, or any other known shape may be used depending on the locking mechanism and the rotating mechanism used in conjunction therewith. It should further be noted that any type of pin or rotating pin 34 maybe arranged in the central pivot orifice 30 of the first and second arm 28 of the base 22 which may allow for the carrier 32 connected thereto to rotate in a 360° arc or any other predetermined arc. It should be noted that any type of pin, roller, bearing, or any other mechanism that is capable of allowing rotation including but not limited to ratchets, or other mechanisms that allow for rotation in predetermined intervals may be used to connect the carrier 32 at the central pivot point of the base 22.

In one embodiment, the rotating autopsy table 20 may include a rotating carrier 32 rotatingly secured to the base 22 at the central pivot point arranged on the first and second arm 28 respectively of the base 22. The carrier 32 may include a rotating arm 36 generally having a rectangular shape, however any other shape may also be used. The rotating arm 36 may have an orifice 38 arranged at a first end and a second end thereof. Generally, the orifice 38 may be circular in shape, however any other shaped orifice may be used depending on the design requirements. The rotating arm 36 may also have a central orifice 40 arranged generally at a mid point thereof wherein the central orifice 40 may receive the rotating pin 34 that is also arranged through the central pivot orifice 30 on each arm 28 of the frame 22. This may allow the carrier 32 to rotate in a 360° arc in either direction with respect to the frame 22 of the rotating autopsy table 20. It should be noted that the rotating arm 36 of the carrier 32 generally is also made of a steel material, however any other material, such as any other known metal, ceramic, plastic, composite, natural material or non natural material may also be used for the rotating arm 36. The carrier 32 also includes a first and second carrier 42,44 which combined to form the overall carrier 32 of the rotating autopsy table 20. The first and second carrier 42,44 generally may have a similar shape. The first carrier 42 generally has a rectangular shape that includes a first and second channel member 46 that are parallel to one another and a first and second cross member 48. Each cross member 48 is arranged between the first and second channel member 46 at two predetermined positions. Generally, one of the cross members 48 may be arranged at or near an end of the channel member 46, while the other cross member 48 may or may not be arranged at or near another end thereof. The channel member 46 generally may have a U-shaped or C-shaped cross section and may have a predetermined length and width. The first and second channel member 46 may each have a first flange 50 extending from one end thereof. The first flange 50 initially extends at a predetermined angle from an end of the first and second channel 46 and then extends at a perpendicular angle to the first and second channel 46 at the end of the first flange 50. The first and second channel 46 may also include a second flange 50 arranged generally at or near a mid point thereof, wherein the second flange 52 has an orifice 54 through a predetermined portion thereof. The orifice 54 generally may have a circular shape, however any other shaped orifice may also be used. The orifice 54 of the second flange 52 may be used to connect the first or second carrier 42, 44 to the rotating arm 36 of the carrier 32 via a lock pin 56. The lock pin 56 may allow for the first and second carrier 42,44 to be secured to the rotating arm 36, thus allowing for no rotation between the first carrier 42 and the second carrier 44 during the flipping procedure of the cadaver body. Any type of locking pin, dowel, screw or any other known mechanical or chemical fastening technique may be used to secure the first carrier 42 and the second carrier 44 to the rotating arm 36 on the respective ends of the rotating arm 36 according to the present invention. Hence, the first carrier 42 may be secured to a first end of the rotating arm 36 while the second carrier 44 may be secured to a second end of the rotating arm 36 according to the present invention. It should be noted that the lock pin 56 used to secure the rotating arm 36 to the second flange 52 of either the first or second carrier 42,44 may have one of the lock pins 56 also arranged through an orifice of at least one of the arms 28 of the frame 22 of the rotating autopsy table 20 in order to secure one of the carriers 42,44 in a predetermined non-rotatable position with respect to the frame 22 of the rotating autopsy table 20. It should be noted that any other method or technique may be used instead of lock pins 56 to secure the carrier to the rotating arm 36. This may allow for the person performing the autopsy thereon to perform the procedure on a fixed and stable surface with respect to the frame 22 of the rotating autopsy table 20. It should be noted that it is also contemplated to use a lock pin 56 through both the first leg 28 and second leg 28 of the frame 22 of the rotating autopsy table 28. In one contemplated embodiment, the second flange 52 may generally have a trapezium shape. It should be noted that any other shape may be used for the second flange 52 that extends from both the first and second channel member 46 of both the first and second carrier 42,44. It should be noted that the second flange 52 extends in the same direction as the first flange 50 from the channel member 46. It should further be noted that any other shape may be used for either the first 50 or second flange 52 depending on the design requirements and environment in which the autopsy table 20 may be used. It should be noted that the first and second cross members 48 of the first and second carrier 42,44 generally have a rectangular shape and have a hollow bore arranged therethrough. It should be noted that in one contemplated embodiment the first and second cross member 48 has a generally rectangular or square cross section. It should be noted that any other known shaped cross section may be used depending on the shape and size of the cross member 48 required. It should be noted that the first and second channel member 46 may also have a stop wall or stop surface arranged at or near the end with the first flange 50 extending therefrom in order to stop and secure a cadaver tray 58 arranged therein. The first and second channel members 46 generally define a first and second channel or slot into which a cadaver tray 58 may be arranged. The first and second channel member 46 form a pocket into which the cadaver tray 58 may be slid and secured therein during the autopsy procedure being performed thereon. It is also contemplated to put a locking mechanism at the opened or second end of the first and second channel member 46 of the carriers 42,44 in order lock the cadaver tray 58 therein such that during rotation of the cadaver from a face up or face down position to the opposite position there is no possibility that one of the cadaver trays slides out of the first or second carrier 42,44. It should be noted that all of the parts described in the entire invention generally are made of a steel material, such as a stainless steel, however any other metal, ceramic, composite, plastic, natural material or non natural material may be used to form and create all of the parts mentioned herein.

As described above, the carrier 32 generally includes a first and second carrier 42,44 which generally are similar in shape and mimic each other and are connected to one another via a pivot point arranged on the first flange 50 of both the first carrier 42 and second carrier 44. Generally, the first flange 50 of either carrier has an orifice 60 arranged near an end thereof. Generally, the orifice 60 may be a circular shape, however any other shaped orifice may be used depending on the design and the environment in which the rotating autopsy table 20 may be used. A rotation pin 62 maybe arranged between the orifice 60 of the first and second carrier 42,44 arranged on the first flanges 50 thereof and may allow for the first carrier 42 one to rotate with respect to the second carrier 44 at one end thereof, thus allowing for either carrier to be stored underneath the cadaver tray 58 which has the body positioned thereon. This may allow for the person performing the autopsy to perform the procedure without any interference from the carrier and/or cadaver tray not currently holding the body thereon. Once the body is placed in its proper position on the tray 58, the locking pin 56 may or may not be secured between either one or both of the arms of the base 22 and the carrier 42, 44 on which the cadaver is arranged. Next, the locking pin 56 may be removed from the carrier 42,44 which is not in use. The tray 58 may be either removed from the carrier 42,44 not being used or locked and secured within that carrier 42,44. After the locking pin 56 is removed from between the second flange 52 and the rotating arm 36 the carrier 42,44 not in use may be rotated through an approximate 270° arc to be stored or arranged underneath the cadaver tray 58 supporting the body. In the stored position, the carrier 42,44 not being used generally may be parallel to the arms 28 of the base 22 or slightly beyond parallel with respect thereto.

As noted above, the rotating autopsy table 20 also includes a first and second standard cadaver body tray 58. Generally, the trays 58 are rectangular in shape and have a predetermined width and length that may be similar to or mimic that of the first and second carrier 42,44 as described above. The cadaver trays 58 generally may have a concave shape that has a lip arranged around the outer periphery thereof in order to keep bodily fluids and parts in a contained area during the autopsy procedure thereon. It should be noted that the cadaver trays 58 generally are made of a stainless steel material, however any other known metal, ceramic, composite, natural material, or non natural material may be used to form the cadaver trays 58. The present invention generally uses standard cadaver trays 58. The use of a first and second cadaver tray 58 may allow for a single person to rotate or flip a cadaver from a face up or face down position to the opposite position in order to autopsy the opposite side of the body. The cadaver trays 58 may have a length that generally may be equal to or slightly less than the length of the carrier 42,44 and may have a first end arranged within a first channel member 46 of the carrier and the second end arranged within the second channel member 46 of the carrier thus allowing for the cadaver tray 58 to be slid into the carrier 42,44 towards the first flange 50 and secured therein when it hits a stop wall or another surface of the first flange 50 according to the present invention. During use, a first cadaver tray 58 is placed within the first carrier 42 for an autopsy procedure to be performed thereon. A body is placed either face up or face down on that cadaver tray 58. The person performing the autopsy then does the autopsy procedure on the first side of the body and if the opposite side of the body has to be autopsied, the second carrier 46 is rotated into position above the body and a second tray 58 is placed therein. The cadaver is then rotated via the central pivot point from either an upward facing or downward facing position to the opposite position, thus allowing for the opposite side of the body to be autopsied thereon. The rotating mechanism used between the carrier 32 and the base 20 allows for a single person to rotate any size body on their own. It should be noted that the rotating mechanism may be any known rotating mechanism that may or may not include ratcheted or geared mechanisms therein to allow for a single person to rotate any size body thereon. It should be noted that during the rotation of the body from either a face down or face up position to the opposite position, the person rotating the body should ensure that the rotation allows for the two ends of the carrier 42,44 connected to one another to rotate in the downward position such that there is no possibility of the cadaver trays 58 falling out of either the first or second carrier 42,44 during the rotating procedure. It should also be noted that as mentioned above, it is also contemplated to have a locking mechanism, such that the cadaver trays 58 are secured within the first and second carrier 42,44 so there is no possibility of the tray 58 and cadaver falling from the carrier 32 no matter which way the carrier 32 is rotated within the rotating autopsy table base 22. It is also contemplated to use a locking stop mechanism in or with the central rotating mechanism that may not allow the carrier 32 to rotate in a direction that would allow for the cadaver trays 58 to slide out of the carrier 32, thus ensuring that the carrier 32 only rotates in a direction that may assure that the cadaver trays 58 stay secured within the carriers 42,44 during the rotating procedure.

It is also contemplated that the cadaver trays 58 may have a plurality of orifices 64 or holes therethrough that may allow for a plurality of pegs or posts 66 to be inserted therein to allow for the body to be secured on the tray 58 during the rotating procedure of the carrier 32. It is also contemplated to have a plurality of orifices that work with a plurality of straps 68, blocks or clamps to limit movement of the cadaver body during rotation of the body between the face up and face down positions via the carrier 32. Hence, any number of orifices 64 in any known shape may be arranged at random positions on the cadaver trays 58 in order to allow for any size and shaped animal or human body to be autopsied on the rotating autopsy table 20. These posts, pegs 66 or straps 68 may keep the cadaver body from sliding or falling off of the top surface of the cadaver tray 58 during the flipping procedure. They also may limit movement of the body, thus assuring proper and respectful rotating of the cadaver body during the autopsy procedure. Hence, any number of pegs 66 and straps 68 may be used according to the present invention. It is contemplated that the straps 68 may have any known size or length and may be made of any known material and may have any known closure mechanism arranged thereon to allow for tightening of the straps to the cadaver size. The posts or pegs 66 that may be used may be of any known shape, such as any known tubular or circular shape, square, triangular, hexagonal, or any other known or unknown shape that fit into the similar shaped holes 64 in the tray 58 and allow for the pegs 66 to be locked in placed during the rotation of the body and then be easily removed after the body has been rotated in order to continue with the autopsy procedure. It should be noted that any other method may also be used to secure and hold the cadaver in place during the rotating procedure. It should be noted that the distance between the first and second carrier 42,44 which defines the gap therein, may be of any known size, but generally may be of a size such that a large animal or person may be arranged therebetween and still allow for the rotation of the body with respect thereto. It is also contemplated to use a plurality of orifices or other adjustment means on the first flange 50 of the carriers 42,44 in order to allow for adjustment of the distance of the gap between the first and second carriers 42,44 in order to allow for different shaped and sized persons and animals to be autopsied with a single table. Thus, other methods of adjusting the size of the gap are contemplated according to the present invention. It should further be noted that generally one of the carriers 42,44 is slightly longer than the other carrier in order to allow for the carriers 42,44 to rotate with respect to one another and to have one of the carriers rotate into a stored position underneath the rotating autopsy table 20 during the autopsy procedure. Hence, one of the rotating carriers may be slightly longer in length than the other in order to allow for a proper rotating connection between the first and second carrier 42,44.

In operation, generally the rotating autopsy table 20 may have a cadaver positioned on one of the cadaver trays 58 and then the tray 58 is loaded into the first carrier 42 or the first cadaver tray 58 may be loaded into the first carrier 42 by sliding therein and then have the cadaver body arranged thereon. Next, after the autopsy procedure has been completed on the first side of the person being autopsied, a second cadaver tray 58 may be arranged into the second carrier 44, thus allowing for the body being autopsied to be rotated while preventing it from falling out or moving during the rotation thereof. As noted above, a plurality of straps, pegs or posts may be arranged around the body to ensure that the body has little movement during the rotating procedure. Once the second tray 58 is arranged in either an upward or downward position within the second carrier 44, the locking pin 56 securing the carrier 32 to the arms 28 of the frame 22 may be removed or another locking mechanism which stops rotation between the rotating arm 36 and base 22 may be disabled thus allowing for the person performing the autopsy to rotate the cadaver body, either manually or automatically with the assistance of a motor, machine, electronics, etc., such that if the body was face up the body will then be face down and arranged on cadaver tray 58 two after the rotating procedure occurs. After the body is rotated, the person performing the autopsy may insert the locking pin 56 between carrier 44 and at least one but preferably both of the arms 28 of the body 22. This may then secure the carrier 44 to the frame 22 of the rotating autopsy table 20. Next, the user of the rotating autopsy table 20 may remove tray one 58 from carrier 42 and store it at another location in the lab. However, it should be noted that cadaver tray one 58 may also stay arranged in the carrier 42 if a locking mechanism is arranged therein in order to keep tray one 58 secured within carrier 42. Next, the person performing the autopsy may remove the locking pins 56 arranged between carrier one 42 and the rotating arm 36 of the carrier 32 and rotate carrier one 42 to its stored position to fully expose the other side of the cadaver for examination thereof. This may allow for the opposite side of the cadaver to be accessible for examination. It should be noted that the reverse operation may be performed if the user wants to flip the cadaver back over to its original autopsy position. The cadaver body during the rotating procedure is positioned between the two cadaver tray surfaces and is able to be rotated with the assistance of the rotation central rotation mechanism by a single person wherein the rotating mechanism is arranged on one of or both of the ends of the carrier 32. Once the rotation has taken place, the carrier holding the cadaver table 58 surface which is now on top, is rotated into the stored position and the table surface that was formerly on top is now holding the cadaver in the opposite direction and serves as the autopsy or dissection surface for the autopsy to be performed on the opposite side of the body.

The present description is for illustrative purposes only and it should not be construed to limit the present invention in any way. Thus, a person skilled in the art will appreciate that various modifications might be made to the present and disclosed embodiments without departing from the scope and spirit of the present invention, which is defined in terms of the claims below. Other aspects, features, and advantages may be apparent upon an examination of the attached drawing figures and appended claims.

What is claimed is:

1. A table for use in an autopsy, necropsy, pathology or dissection procedure, said table comprising:

a base;

a carrier rotatably connected to said base;

an arm having a first orifice arranged at a first end, a second orifice arranged at a second end, and a third orifice arranged generally at a midpoint thereof, said arm rotates at said midpoint with respect to said base, said arm is arranged between said base and said carrier;

a first tray arranged within said carrier, said first tray configured to support a cadaver; and a second tray arranged within said carrier, said second tray is parallel to said first tray when in a first position, said second tray and said first tray having a predetermined sized gap arranged therebetween when in said first position, said second tray is underneath and generally perpendicular to said first tray when in a second position.

2. The table of claim 1 wherein said base having a first and second arm, said first and second arm engage with said carrier.

3. The table of claim 1 wherein said carrier having a first carrier member and a second carrier member.

4. The table of claim 3 wherein said first and second carrier members are rotatably connected to one another.

5. The table of claim 4 wherein said first and second carrier members are rotatably connected at a first end of said first carrier member and a first end of said second carrier member.

6. The table of claim 3 wherein said first tray is removably secured within said first carrier member.

7. The table of claim 6 wherein said second tray is removably secured within said second carrier member, said second carrier member is without said second tray when in said second position.

8. The table of claim 1 wherein said carrier rotates approximately 180° in order to move said first tray from a bottom position to a top position with respect to said base.

9. The table of claim 3 wherein said arm on said first end contacts and is removably connected to said first carrier member, said arm on said second end contacts and is removably connected to said second carrier member.

10. The table of claim 4 wherein said first carrier member rotates approximately 270° with respect to said second carrier member.

11. The table of claim 1 wherein said carrier having a first pocket and a second pocket.

12. The table of claim 11 wherein said first pocket having said first tray arranged therein, said second pocket having said second tray arranged therein.

13. The table of claim 1 wherein said first and second tray each having posts or straps arranged thereon.

14. A table for use in an autopsy, necropsy, pathology or dissection procedure, said table comprising:

a base;

a carrier rotatably connected to said base, said carrier having a first carrier member and a second carrier member, said first carrier member having a channel member, said first carrier member having a flange extending from an end of said channel member, said first carrier member having a cross member arranged near another end of said channel member;

a first tray arranged within said carrier, said first tray configured to support a cadaver; and a second tray arranged within said carrier, said second tray is parallel to said first tray when in a first position, said second tray and said first tray having a predetermined sized gap arranged therebetween when in said first position, said second tray is underneath and generally perpendicular to said first tray when in a second position.

15. A method of rotating a cadaver during an autopsy, necropsy, pathology or dissection procedure, said method comprising the steps of:

placing the cadaver face up on a first tray of a rotating autopsy table, said rotating autopsy table having a base and a carrier, said carrier having a channel member, said carrier having a flange extending from an end of said channel member, said carrier having a cross member arranged from another end of said channel member;

storing a second tray of the rotating autopsy table underneath and generally perpendicular to said first tray;

performing the procedure on a front of the cadaver;

rotating a second tray to cover said face up cadaver;

rotating said autopsy table approximately 180';

storing said first tray of the rotating autopsy table underneath and generally perpendicular to said second tray; and performing the procedure on a back of the cadaver.

16. The method of claim 15 wherein said carrier having a first pocket and a second pocket.

17. The method of claim 16 wherein said first tray is removably secured within said first pocket, said second tray is removably secured within said second pocket, said first pocket is without said first tray when in said stored position, said second pocket is without said second tray when in said stored position.

18. The method of claim 15 further comprising the step of securing the cadaver to said first tray with posts or straps.

* * * * *